United States Patent [19]

Bouwknegt et al.

[11] Patent Number: 4,859,207

[45] Date of Patent: Aug. 22, 1989

[54] PROCESS FOR DYEING TEXTILE PLANAR FABRICS MADE FROM POLYAMIDES: WITH MELAMINE COMPOUND AS RESIST AGENT

[75] Inventors: Thys Bouwknegt; Heinz Abel, both of Reinach, Switzerland

[73] Assignee: Ciba-Geigy Corporation, Ardsley, N.Y.

[21] Appl. No.: 221,401

[22] Filed: Jul. 19, 1988

[30] Foreign Application Priority Data

Jul. 27, 1987 [CH] Switzerland ..... 2862/87

[51] Int. Cl.[4] ..... D06P 5/12; C09B 67/00

[52] U.S. Cl. ..... 8/455; 8/451; 8/566; 8/588; 8/676; 8/683; 8/917; 8/924; 8/648

[58] Field of Search ..... 8/455, 566

[56] References Cited

U.S. PATENT DOCUMENTS 3,097,911 7/1963 Moll ..... 8/446
3,743,477 7/1973 Egli et al ..... 8/480

FOREIGN PATENT DOCUMENTS 1226653 3/1971 United Kingdom .

*Primary Examiner*—A. Lionel Clingman

*Attorney, Agent, or Firm*—Edward M. Roberts

[57] ABSTRACT

A process for dyeing textile planar fabrics made from natural or synthetic polyamides with anionic dyes by (a) locally applying a resist agent by itself or in conjunction with an anionic dye of fluorescent whitening agent, (b) subjecting the textiles to a heat treatment, and (c) carrying out ground dyeing with a dye liquor that contains a further anionic dye, which process comprises using, as resist agent, a melamine compound of formula (1)

wherein $R_1$, $R_2$ and $R_3$ are each independently phenyl or naphthyl, each of which may be substituted by halogen, hydroxy, $C_1$–$C_3$alkyl or $C_1$–$C_3$alkoxy, Z is an acid water-solubilizing group, and m is 1 to 6.

10 Claims, No Drawings

PROCESS FOR DYEING TEXTILE PLANAR FABRICS MADE FROM POLYAMIDES: WITH MELAMINE COMPOUND AS RESIST AGENT

The present invention relates to a process for dyeing textile planar fabrics made of natural or synthetic polyamides, in particular wool, with anionic dyes, by (a) locally applying a resist agent by itself or in conjunction with an anionic dye or fluorescent whitening agent, (b) subjecting the textiles to a heat treatment, and (c) carrying out ground dyeing with a dye liquor that contains a further anionic dye, which process comprises using, as resist agent, a melamine compound of formula

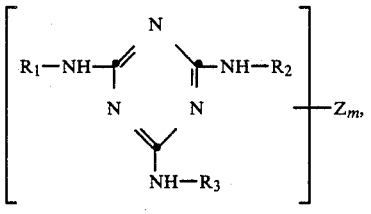

(1)

wherein $R_1$, $R_2$ and $R_3$ are each independently phenyl or naphthyl, each of which may be substituted by halogen, hydroxy, $C_1$–$C_3$alkyl or $C_1$–$C_3$alkoxy, Z is an acid water-solubilising group, and m is 1 to 6. The white or coloured effects thereby obtained are particularly excellent on wool.

The amount of melamine compound depends especially on the amount of dye employed and on the desired resist or coloured print, but an amount of 50 to 150 g per liter of resist formulation has proved advantageous.

The melamine compound preferably contains 1 to 4, most preferably 2 to 4, acid water-solubilising groups, which may be in particular carboxyl or sulfo groups. In addition, a melamine compound may contain only carboxyl groups or only sulfo groups as well as both carboxyl and sulfo groups.

$R_1$, $R_2$ and $R_3$ in the melamine compounds of formula (1) may be identical or different. Preferably, $R_1$, $R_2$ and $R_3$ are each phenyl.

The melamine compounds employed in the process of this invention are known per se or they can be prepared by methods which are known per se.

Particularly interesting melamine compounds are, for example, those of formulae

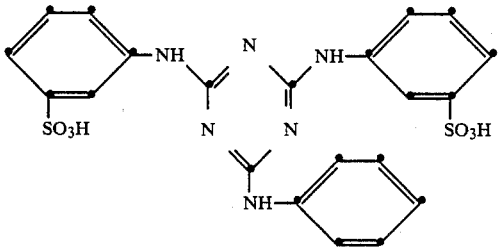

(2)

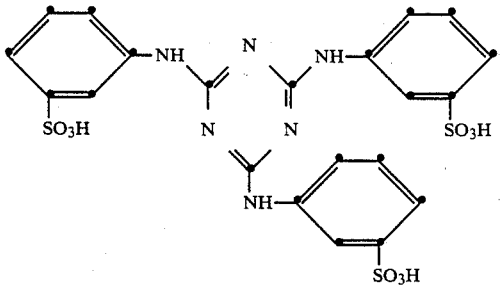

(3)

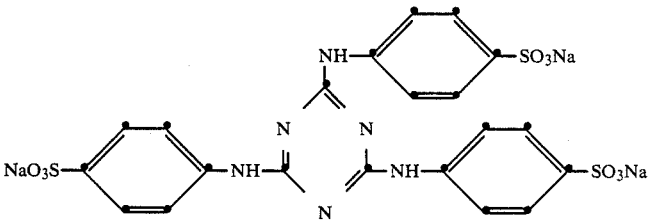

(4)

-continued
(5)
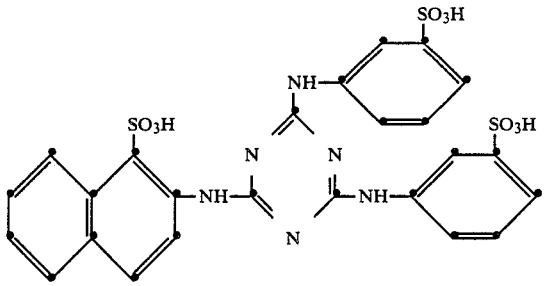
(6)
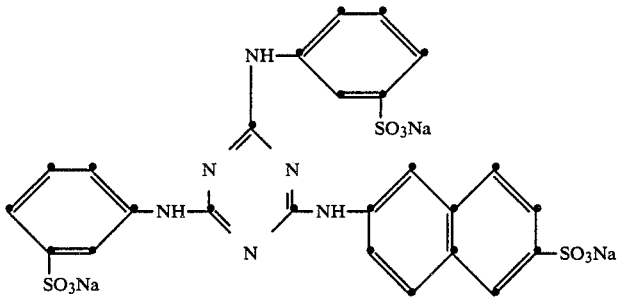
(7)
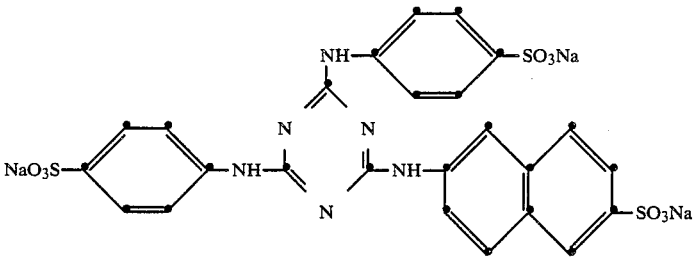
(8)
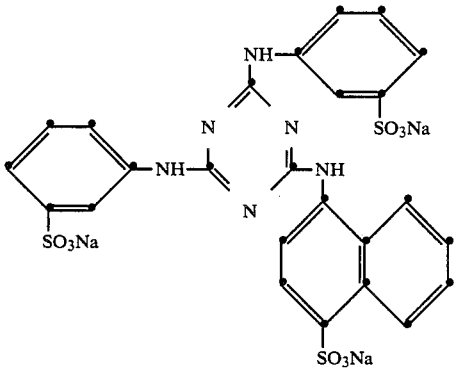
(9)
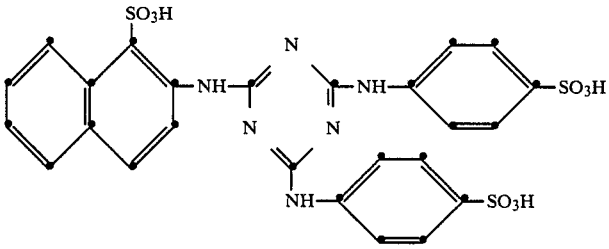
or -continued

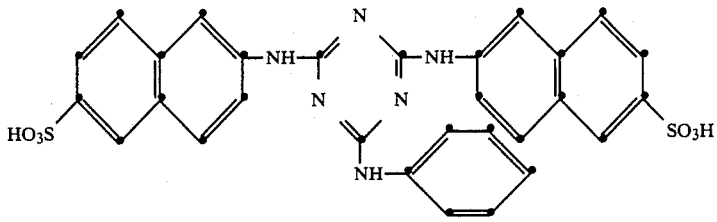

(10)

The melamine compounds employed in the process of this invention are either in the form of the free acid or, preferably, as salts thereof. Examples of suitable salts are the alkali metal salts, alkaline earth metal salts or ammonium salts or the salts of an organic amine. Examples of such salts are the sodium, potassium or ammonium salts or the salt of triethanolamine.

The anionic dyes used for the process of the invention are known from the Colour Index. In principle, all anionic dyes are suitable.

The anionic dyes employed in the process of this invention may be for example salts of metallised or unmetallised monoazo, disazo or polyazo dyes, including formazan dyes, as well as of anthraquinone, xanthene, nitro, triphenylmethane, naphthoquinoneimine and phthalocycanine dyes. The anionic character of these dyes can be determined by metal complexing alone and/or preferably by acid salt-forming substituents such as carboxylic acid groups, sulfuric acid groups and phosphonate groups, phosphonic acid groups or sulfonic acid groups. These dyes may also contain reactive groups in the molecule, which groups are able to form a covalent bond with the material to be dyed. Acid unmetallised reactive dyes which preferably contain two sulfonic acid groups are preferred.

Of particular interest are also the 1:1 metal complex or, preferably, 1:2 metal complex dyes. The 1:1 metal complex dyes preferably contain one or two sulfonic acid groups. As metal they contain a heavy metal atom, for example a copper, nickel or, preferably, chromium atom. The 1:2 metal complexes contain as central metal atom a heavy metal atom, for example a cobalt atom or, preferably, a chromium atom. Two complexing components are attached to the central metal atom, at least one of which components is a dye molecule; but preferably both components are dye molecules. Further, the two complexing dye molecules may be identical or different. The 1:2 metal complex dyes may contain e.g. two azomethine molecules, one disazo dye molecule and one monoazo dye molecule or, preferably, two monoazo dye molecules. The azo dye molecules may contain water solubilising groups, e.g. acid amide groups, alkylsulfonyl groups or the acid groups mentioned above. Preferred 1:2 metal complex dyes are 1:2 cobalt or 1:2 chromium complexes of monoazo dyes, which complexes contain acid amide groups, alkylsulfonyl groups or a single sulfonic acid group.

The dyeings are preferably produced with the following groups of dyes:

A. 1:1 Chromium complex dyes which contain sulfonic acid groups, i.e. complex chromium compounds of dyes, especially monoazo dyes, wherein one chromium atom is attached to a complex dye molecule and which contain at least one sulfonic acid group in the molecule.

B. 1:2 Chrome or cobalt complex dyes, the complex molecule of which contains 1 or 2 acid water-solubilising groups which do not participate in the complexing, preferably a single sulfonic acid group.

C. Reactive dyes obtained from azo dyes which contain one or two acid water-solubilising groups, preferably sulfonic acid groups.

d. 1:2 Chrome or cobalt complex dyes which are devoid of acid groups but contain water-solubilising groups such as sulfonyl groups, e.g. $C_1$–$C_4$-alkylsulfonyl groups or sulfonamide groups which may be substituted by one or two $C_1$–$C_4$alkyl groups.

Of especial interest for the ground dyeing or metal-free anthraquinone dyes and/or azo dyes which each contain a single sulfo group.

Particularly suitable for simultaneous use with the melamine compound are 1:2 metal complex dyes which contain a single sulfo group and, most particularly, reactive dyes which contain two sulfo groups.

Mixtures of anionic dyes can also be used, for example mixtures of at least two or three anionic dyes.

The amount of dyes employed depends on the desired colour strength of the resist and coloured print. In general, amounts of 0.02 to 10 percent by weight, preferably 0.05 to 5 percent by weight, based on the fabric, have proved useful.

Instead of, or in addition to, a dye it is also possible to use anionic fluorescent whitening agents.

Suitable fibre materials are synthetic polyamide, silk or, preferably, wool by itself or also blends of wool and polyamide. Synthetic polyamide is typically that made from adipic acid and hexamethylenediamine (polyamide 66), from ε-caprolactam (polyamide 6), from ω-aminoundecanoic acid (polyamide 119, from ω-aminoenanthic acid (polyamide 7), from ω-aminopelargic acid (polyamide 8), or from sebacic cid and hexamethylenediamine (polyamide 6,10).

The textile fabrics are planar and are, in particular, floor coverings, for example carpets or other home textiles such as upholstery fabrics, curtains or wall coverings.

The formulations for the selective (local) applications of the resist agent alone or in conjunction with the dye or fluorescent whitening agents, as well as the dye liquors for the cross-dyeing, conveniently contain mineral acids, for example sulfuric acid or phosphoric acid, or organic acids such as formic acid, acetic acid, oxalic acid or, preferably, citric acid. They can also contain salts such as ammonium acetate, ammonium sulfate or sodium acetate. The acids are used in particular for adjusting the pH of the formulations or liquors. The pH is normally in the range from 3 to 7, preferably from 3.5 to 4.5.

In addition to the melamine compounds (resist agents), the dyes or fluorescent whitening agents, further assistants conventionally employed in dyeing technology may be concurrently used. Such further assistants are typically dispersants, levelling agents, electrolytes, wetting agents, antifoams, thickeners or wool protecting agents.

The resist print or the selective colouration is effected by conventional printing methods, for example with the aid of drops, printing rollers or by means of screens. This local application can be made on dry or prewetted goods. For the selective coloration it is expedient to use fast dyes such as reactive dyes and/or metal complex dyes.

The heat treatment for presetting the fabric after effecting the resist or selective colouration is carried out usually with saturated steam at 100°–105° C. or hot air at 120°–160° C., and generally takes from 5 to 20 minutes, preferably from 7 to 15 minutes when using saturated steam and from 60 to 120 seconds when using hot air. After this presetting, the cross-dyeing to produce the ground dyeing is carried out.

The cross-dyeing is preferably carried out with acid dyes, which usually have migration properties.

The ground dyeing can be carried out by the exhaust process or by impregnation, continuously or semi-continuously, or also by printing. Impregnation can be effected by applying the dye liquor by, for example, spraying, nip-padding or curtain coating.

In the exhaust process, the liquor to goods ratio can vary within a wide range, for example from 1:3 to 1:100, preferably from 1:10 to 1:40. The process is conveniently carried out in the temperature range from 30° to 98° C., preferably from 50° to 70° C.

In the impregnating or continuous process, the liquor pick-up is preferably 250 to 800% by weight. The goods are then subjected to a second heat treatment in order to fix the dyes. This fixation can also be carried out by the cold pad-batch method.

The heat treatment is preferably carried out by a steaming process in a steamer with steam or superheated steam in the temperature range from 98° to 105° C. The dyes are fixed by the cold pad-batch method by storing the impregnated, and preferably rolled up, goods at room temperature (15°–30° C.), for example for 3 to 24 hours. It is common knowledge that the cold dwell time depends on the dye.

Upon conclusion of the dyeing process and fixation, the dyeings so obtained are washed and dried in conventional manner.

The dyeings obtained by the process of this invention have good build-up and excellent properties. The dyeings are therefore fast to light, washing and rubbing. Damage to the wool is insignificant. Good results are obtained on wool of low felting properties and on wool with antifelting finish. The process of this invention makes it possible to dye fabric of identical quality in simple manner in different shades. This feature is of particularly great importance in carpet manufacture, as it is consequently possible to produce carpets of uniform appearance as regards resilience and lustre of the pile. In addition, the process is economical, because usually an intermediate washing or drying or both and an expensive storage of large amounts of predyed material can be dispensed with.

In the following Examples, parts and percentages are by weight.

EXAMPLE 1

(a) A wool cut-pile carpet is selectively printed with an aqueous printing paste containing 100 g/l of 2,4,6-tris(3'-sulfophenylamino)-1,3,5-triazine,
10 g/l of locust bean gum (commercial grade),
1 g/l of the ammonium salt of the sulfated polyadduct of 1 mole of nonylphenol and 2 moles of ethylene oxide, and
1 g/l of a silicone-free antifoam, and which is adjusted to pH 3.5 with citric acid.

The printed carpet is steamed for 12 minutes in saturated steam and then rinsed cold.

(b) The printed carpet is then dyed on a winchbeck for 45 minutes at 60°–65° C. at a liquor ratio of 1:30 with an aqueous liquor containing 0.048% of a dye of formula

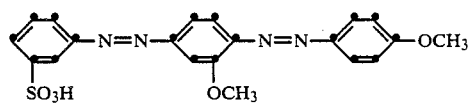

(101)

0.018% of a dye of formula

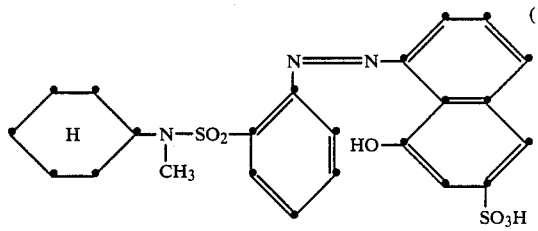

(102)

0.034% of a dye of formula

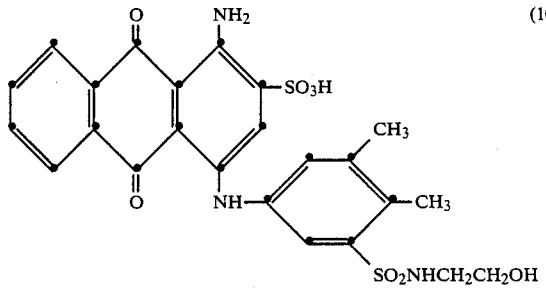

(103)

and which is adjusted to pH 4 with citric acid. After dyeing, the carpet is rinsed cold and dried. The carpet is dyed in bright patterns on a beige ground shade.

EXAMPLE 2

(a) A wool cut-pile carpet is selectively printed with an aqueous printing paste containing 100 g/l of 2,4,6-tris(3'-sulfophenylamino)-1,3,5-triazine,
3 g/l of a dye of formula

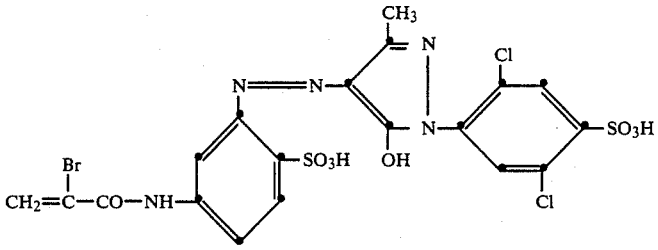

(104)

1 g/l of the ammonium salt of the sulfated polyadduct of 2 moles of ethylene oxide and 1 mole of nonyl phenol,
2 g/l of a commercially available silicone-free antifoam, and
15 g/l of commercially available locust bean gum,
and which is adjusted to pH 3.5 with citric acid.

The printed carpet is treated with saturated steam for 15 minutes and then washed off with warm water of 40°-50° C.

(b) The printed carpet is then impregnated on a winchbeck for 45 minutes at 60°-65° C. as described in Example 1(b) with a liquor containing the dyes of formulae (101), (102) and (103). The printed pattern has a pure yellow shade and soft contours on a beige ground shade.

EXAMPLE 3

A wool cut-pile carpet which has been selectively printed as described in Example 2(a) is impregnated on a padder to a pick-up of 400% with an aqueous liquor containing
0.12 g/l of a dye of formula (101),
0.045 g/l of a dye of formula (102),
0.085 g/l of a dye of formula (103),
1 g/l of a mixture of diethanol cocosylamide and the ammonium salt of the sulfated polyadduct of 3 moles of ethylene oxide and 1 mole of lauryl alcohol (1:1.7), and
2 g/l of commercially available locust bean gum, and which is adjusted to pH 4 with citric acid. The goods are thereafter steamed for 10 minutes with saturated steam of 140° C. On the printed areas, the pattern has a yellow shade on a beige ground shade.

What is claimed is:

1. A process for dyeing textile planar fabrics made from natural or synthetic polyamides with anionic dyes by (a) locally applying a resist agent by itself or in conjunction with an anionic dye or fluorescent whitening agent, (b) subjecting the textiles to a heat treatment, and (c) carrying out ground dyeing with a dye liquor that contains a further anionic dye, which process comprises using, as resist agent, a melamine compound of formula

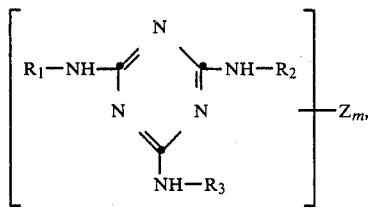

(1)

wherein $R_1$, $R_2$ and $R_3$ are each independently phenyl or naphthyl, each of which is unsubstituted or substituted by halogen, hydroxy, $C_1$-$C_3$alkyl or $C_1$-$C_3$alkoxy, Z is an acid water-solubilising group, and m is 1 to 6.

2. A process according to claim 1, wherein Z is a sulfo group and m is 1 to 4.

3. The process of claim 2, wherein m is 2 or 3.

4. A process according to claim 1, wherein $R_1$, $R_2$ and $R_3$ are each phenyl.

5. A process according to claim 1, wherein the melamine compound is used in an amount of 50 to 150 g per liter of resist formulation.

6. A process according to claim 1, wherein the ground dyeing is carried out with anthraquinone dyes or metal-free azo dyes, wherein each dye contains a single sulfo group.

7. A process according to claim 1 for dyeing wool.

8. A process according to claim 1, wherein the heat treatment is carried out with saturated steam.

9. A process according to claim 1, wherein the ground dyeing (c) is carried out by the exhaust process.

10. A process according to claim 1, wherein the ground dyeing (c) is carried out by the impregnating process and subsequent heat treatment with steam.

* * * * *